United States Patent [19]

Terris

[11] 4,176,485

[45] Dec. 4, 1979

[54] DIRECTIONAL SIGN

[76] Inventor: James M. Terris, 2126 Dillon Dr., Fayetteville, N.C. 28306

[21] Appl. No.: 927,645

[22] Filed: Jul. 24, 1978

[51] Int. Cl.[2] ..... G09F 7/00

[52] U.S. Cl. ..... 40/584; 40/612; 116/319

[58] Field of Search ..... 40/584, 446, 486, 492, 40/493, 495, 497, 612, 610, 598, 591, 124.1; 116/319, 320, 47, 209; 283/32, 37, 56

[56] References Cited

U.S. PATENT DOCUMENTS

| | | | |
|---|---|---|---|
| 695,074 | 3/1902 | Newby | 116/319 |
| 1,406,130 | 2/1922 | Womack | 116/47 |
| 1,417,519 | 5/1922 | Hannah | 40/584 |
| 3,131,495 | 5/1964 | Stodola | 40/584 |

FOREIGN PATENT DOCUMENTS

| | | | |
|---|---|---|---|
| 553464 | 6/1932 | Fed. Rep. of Germany | 116/47 |
| 172523 | 1/1935 | Switzerland | 40/492 |

*Primary Examiner*—John F. Pitrelli

*Attorney, Agent, or Firm*—Bell, Seltzer, Park & Gibson

[57] ABSTRACT

A changeable directional sign for providing observers with directional information to a particular location or event and including a generally rectangular sign board having a height dimension greater than its width dimension and with printed indicia on the face of the sign board describing a particular location or event. An elongate indicator of a length no greater than the height dimension of the sign board is pivotally secured to the rear of the sign board at a predetermined location on the upper medial portion of the sign board. The indicator, when manually positioned either upwardly, to the left, or to the right, extends in projecting relation beyond either the upper or side edges of the sign board to thereby indicate to the observer of the sign that the direction which should be followed to the particular location or event is either straight ahead, to the left, or to the right. When the indicator is positioned in a downward direction relative to the sign board, the indicator is in a storage position concealed behind and within the periphery of the sign board to facilitate packaging.

6 Claims, 5 Drawing Figures

DIRECTIONAL SIGN

This invention relates to directional signs, and in particular to a changeable directional sign for providing observers with directional information to a particular location or event.

Occasions frequently arise when an individual has need for a sign for furnishing directions to a particular location or event. Numerous examples could be cited. For example, a homeowner who wishes to sell his house needs signs for directing prospective customers from a busy thoroughfare to the location of his house in a residential area. Garage sales or similar sales are frequently conducted by homeowners, and directional signs are also needed for directing prospective customers to the location of such an event. Directional signs are also needed for marking the route of a marathon run or bicycle race.

Relatively inexpensive signs formed of cardboard or sheet metal have long been available at hardware stores and similar places and carry such information as HOUSE FOR SALE, FOR RENT, etc. This type of readily available signs however does not generally furnish directional information, and consequently it is a common practice for a homeowner or individual to prepare and post his own homemade sign carrying the directional information he wishes to convey. Such signs are frequently difficult to read and obviously carry less of an impact that a printed sign.

With the foregoing in mind, it is an important object of the present invention to satisfy the need for a relatively inexpensive directional sign which may be used by homeowners and individuals for conveying directional information to a variety of locations or events.

More particularly, it is an object of the present invention to provide a unique type of directional sign which may be inexpensively manufactured and which is capable of directing the observer in any desired direction to a designated location or event.

These and other objects are achieved in accordance with the present invention with a changeable directional sign which has printed information provided on the face thereof describing the particular location or event, and which has a directional indicator pivotally secured thereto and which may be manually positioned so as to indicate to the observer of the sign the particular direction which should be followed.

More particularly, the present invention provides a changeable directional sign for providing observers with directional information to a particular location or event, and wherein the sign comprises a rectangular sign board having a height dimension greater than its width dimension, indicia on the face of the sign board describing the particular location or event and an elongate indicator of a length no greater than the height dimension of the sign board. Means is provided pivotally securing the elongate indicator to the rear of the sign board at a predetermined location on the upper medial portion of the sign board so that the indicator, when manually positioned either upwardly, to the left, or to the right, extends in projecting relation beyond either the upper or side edges of the sign board to thereby indicate to the observer of the sign that the direction which should be followed to the particular location or event is either straight ahead, to the left, or to the right. When the indicator is positioned in a downward direction relative to the sign board, the indicator is in a storage position concealed behind and within the periphery of the sign board to facilitate packaging.

Some of the objects and features of the invention having been described, others will become apparent as the description proceeds when taken in connection with the accompanying drawings, in which—

Referring now more particularly to the drawings, the directional sign of the present invention includes a generally rectangular sign board 10 formed of a flat sheet material such as paperboard, sheet metal, or plastic. As illustrated, the rectangular sign board has a height dimension greater than its width dimension and has information imprinted on the face of the sign board describing a particular location or event.

The following listing is exemplary of the kind of information which may be provided on the face of the sign: YARD SALE, GARAGE SALE, OPEN HOUSE, FLEA MARKET, CAR WASH, HORSE SHOW, PARKING, EXIT, AUCTION, ESTATE SALE, MARATHON, HOUSE FOR SALE, BOAT SHOW. In addition, in some instances it may be desirable to provide signs with a blank face to be filled in by the purchaser, or with printed information together with blank areas for receiving additional information to be filled in by the purchaser, such as times, dates, telephone numbers, etc.

The sign additionally includes an elongate directional indicator 11 also formed of generally flat sheet material similar to the material from which the sign board 10 is formed. The directional indicator has a length dimension which corresponds substantially to the height dimension of the sign board 10 and has a width which is considerably less than the width dimension of the sign board. Preferably, and as illustrated, the elongate directional indicator is in the form of an arrow and has a pointer 12 provided at one end thereof for indicating a particular direction to be followed.

Figure 1:
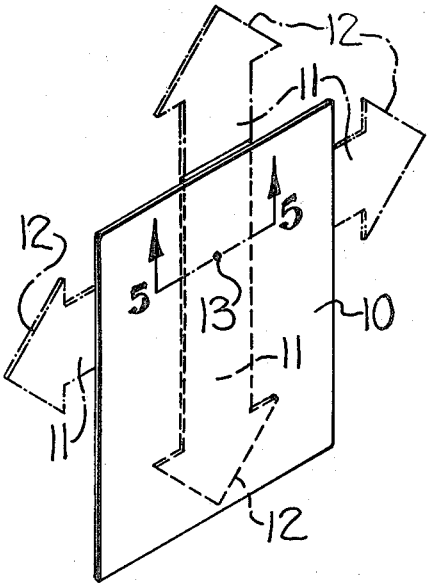
FIG. 1 is a front perspective view of the sign showing in broken lines three positions which the pivoted arrow may assume for conveying directional information, and a fourth position which the arrow may assume for storage purposes.
Figure 2:
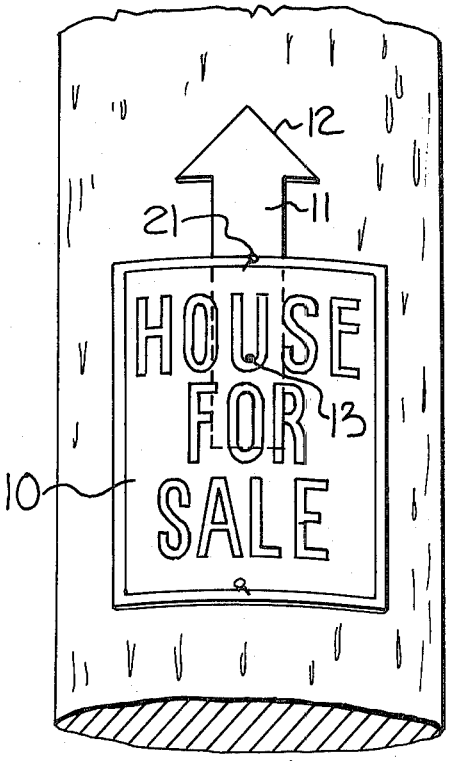
FIG. 2 is a view showing a portion of a telephone pole to which a directional sign in accordance with this invention has been nailed.

As illustrated, the directional indicator 11 is pivotally secured to the sign board by a rivet 13 extending through and interconnecting the sign board 10 and the elongate indicator 11, or by other suitable fastener means. The elongate indicator 11 is pivotally secured to the rear of the sign board 10 at a predetermined location on the upper medial portion of the sign board. More specifically, as illustrated the fastener means penetrates the sign board 10 at a location approximately equidistant from opposite side edges of the sign board and closer to the upper edge of the sign board than to the lower edge. The fastener means penetrates the elongate indicator 11 at a location approximately equidistant from opposite side edges of the indicator and further from the end thereof which carries the pointer 12 than from the opposite end of the indicator. When connected to the sign board 10 in this location, the indicator 11 may be manually positioned with the pointer means 12 extending either upwardly, to the left, or to the right, and the pointer will project beyond the upper or side edges of the sign board as shown in FIGS. 1 and 2 to indicate to the observer of the sign the particular direction which should be followed to the location or event described on the face of the sign. In this regard, the indicator pointing upwardly will signify that the observer should continue straight ahead, while the indicator pointing to the left or right will signify that the observer should turn in the indicated direction.

Figure 3:
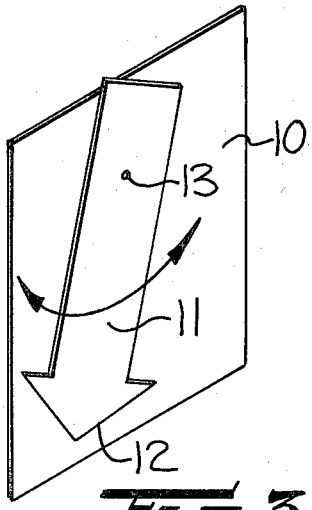
FIG. 3 is a rear view of the sign showing how the arrow is pivotally secured to the sign.
Figure 4:
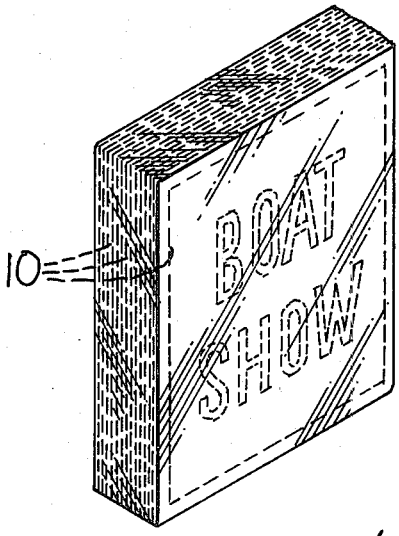
FIG. 4 is a view illustrating a number of directional signs which have been packaged together.
Figure 5:
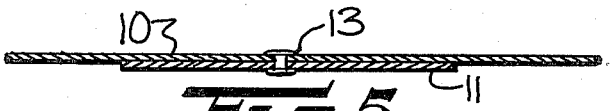
FIG. 5 is a cross sectional view of the sign taken substantially along the line 5—5 of FIG. 1.

Additionally, as is evident from FIGS. 1 and 3, when the indicator 11 is positioned with the pointer 12 directed downwardly toward the bottom of the sign board 10, the indicator is in a storage position concealed behind and completely within the periphery of the sign board 10. Thus, with the indicator in the storage position, the sign has a rectangular configuration with no projections extending therefrom and can be readily packaged for sale. In most instances it will be desirable to sell the signs prepackaged with several signs to a package, as illustrated in FIG. 4, and consequently, the ability to position the directional indicator in the concealed storage position is a significant aspect of this invention.

When the sign is installed for use, the user will select an appropriate location for the sign, usually at an intersection for example, and position the indicator so as to point in the appropriate direction for guiding the observer. As illustrated in FIG. 2, the sign may then be secured to a suitable support, such as a telephone pole 20 for example, by an appropriate fastener 21 such as a nail or staple. Preferably, and as illustrated, the user will position the fastener 21 so as to pass through both the sign board 10 and a portion of the indicator 11 located behind the sign board. In this manner, the nail or staple used for fastening the sign to the underlying support will additionally serve to prevent undesired movement of the indicator after the sign has been mounted in position for observation.

In the drawings and specification, there has been set forth a preferred embodiment of the invention, and although specific terms are employed, they are used in a generic and descriptive sense only and not for purposes of limitation. That which is claimed is:

1. A changeable direction sign for providing observers with directional information to a particular location or event, said sign comprising a rectangular sign board having a height dimension greater than its width dimension, indicia on the face of said sign board describing the particular location or event, an elongate indicator of a length no greater than the height dimension of said sign board, means pivotally securing said elongated indicator to the rear of said sign board at a predetermined location on the upper medial portion of said sign board so that the indicator when manually positioned either upwardly, to the left, or to the right, extends in projecting relation beyond either the upper or side edges of the sign board to thereby indicate to the observer of the sign that the direction which should be followed to said particular location or event is either straight ahead, to the left, or to the right, and when the indicator is positioned in a downward direction relative to the sign board, the indicator is in a storage position concealed behind and within the periphery of the sign board to facilitate packaging.

2. A directional sign according to claim 1 wherein said indicator comprises an elongate flat member formed of material similar to said sign board and being of a length dimension substantially corresponding to the height dimension of said sign board and of a width dimension considerably less than the width dimension of the sign board.

3. A directional sign according to claim 2 wherein said elongate flat member is in the form of an arrow and has means at one end thereof defining a pointer for indicating a particular direction to be followed.

4. A directional sign according to claim 1 wherein said means pivotally securing the indicator to the sign board comprises a rivet.

5. A directional sign according to claim 1 including fastener means extending through said sign board and into an underlying substrate for securing the sign in position for observation, and said fastener means also extending through a portion of said elongate indicator located behind said sign board to secure the indicator in the desired position for providing directional information and to prevent undesired movement of the indicator after the sign has been mounted in position for observation.

6. A changeable directional sign for providing observers with directional information to a particular location or event, said sign comprising a rectangular sign board formed of generally flat sheet material having a height dimension greater than its width dimension; characters imprinted on the face of said sign board describing the particular location or event; an elongate directional indicator also formed of generally flat sheet material and having a length dimension corresponding substantially to the height dimension of said sign board and a width dimension considerably less than the width dimension of said sign board and having means at one end of the elongate indicator defining a pointer for indicating a particular direction to be followed; fastener means penetrating said sign board and said elongate indicator and pivotally securing the indicator to the rear of said sign board, said fastener means penetrating said sign board at a location approximately equidistant from opposite side edges of the sign board and closer to the upper edge of the sign board that the lower edge, and said fastener means penetrating said elongate indicator at a location approximately equidistant from opposite side edges of the indicator and further from end thereof having said pointer means than from the opposite end of the indicator so that the indicator, when manually positioned with the pointer means extending either upwardly, to the left, or to the right, has the pointer means extending in projecting relation beyond either the upper or side edges of the sign board to thereby indicate to the observer of the sign that the direction which should be followed to the particular location or event is either straight ahead, to the left, or to the right, and when the indicator is positioned with the pointer means extending in a downward direction relative to the sign board, the indicator is in a storage position concealed behind and within the periphery of the sign board to facilitate storage and packaging.

* * * * *

UNITED STATES PATENT OFFICE

CERTIFICATE OF CORRECTION

PATENT NO. : 4,176,485

DATED : December 4, 1979

INVENTOR(S) : James M. Terris

It is certified that error appears in the above-identified patent and that said Letters Patent are hereby corrected as shown below:

Claim 6, Column 4, line 46, "that" should be --than--.

Signed and Sealed this

*Fourth* Day of *March 1980*

[SEAL]

*Attest:*

SIDNEY A. DIAMOND

*Attesting Officer*

*Commissioner of Patents and Trademarks*